US007287969B2

(12) United States Patent
Fugle

(10) Patent No.: US 7,287,969 B2
(45) Date of Patent: Oct. 30, 2007

(54) ROTARY FLUID PRESSURE DEVICE AND IMPROVED BRAKE ASSEMBLY FOR USE THEREWITH

(75) Inventor: Thomas R. Fugle, Shakopee, MN (US)

(73) Assignee: Eaton Corporation, Cleveland, OH (US)

( * ) Notice: Subject to any disclaimer, the term of this patent is extended or adjusted under 35 U.S.C. 154(b) by 231 days.

(21) Appl. No.: 11/037,631

(22) Filed: Jan. 18, 2005

(65) Prior Publication Data

US 2006/0159581 A1 Jul. 20, 2006

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |

(52) U.S. Cl. ..... 418/61.3; 418/69

(58) Field of Classification Search ..... 418/61.3, 418/69

See application file for complete search history.

(56) References Cited

U.S. PATENT DOCUMENTS

| | | | | |
|---|---|---|---|---|
| 3,441,110 | A * | 4/1969 | Ruggen | 188/170 |
| 3,680,666 | A * | 8/1972 | Sommer | 188/170 |
| 4,613,292 | A * | 9/1986 | Bernstrom et al. | 418/61.3 |
| 4,930,312 | A * | 6/1990 | Metcalf | 60/442 |
| 4,940,401 | A * | 7/1990 | White, Jr. | 418/61.3 |
| 4,981,423 | A * | 1/1991 | Bissonnette | 418/61.3 |
| 5,114,324 | A * | 5/1992 | Spindeldreher | 418/61.3 |
| 6,030,194 | A * | 2/2000 | Yakimow et al. | 418/61.3 |
| 6,033,195 | A * | 3/2000 | Uppal | 418/61.3 |
| 6,062,835 | A | 5/2000 | Acharya et al. | |
| 6,132,194 | A | 10/2000 | Wenker et al. | |
| 6,321,882 | B1 | 11/2001 | Heckel et al. | |
| 6,345,968 | B1 * | 2/2002 | Shupe | 418/61.3 |
| 6,594,993 | B1 * | 7/2003 | Friedrichsen et al. | 60/442 |
| 6,743,002 | B1 * | 6/2004 | Millar et al. | 418/61.3 |

* cited by examiner

*Primary Examiner*—Thomas Denion
*Assistant Examiner*—Douglas J. Duff
(74) *Attorney, Agent, or Firm*—Sonu N. Weaver

(57) ABSTRACT

A rotary fluid pressure device defining a fluid inlet (17), an output shaft (37), and a housing (41,43) defining a brake chamber (61), a piston member (63,65) being disposed therein and biased toward an engaged position by a spring (69). Braking means (57,59) is associated with the piston and the output shaft, such that movement of the piston to the engaged position results in braking of said output shaft. The housing defines a fluid pressure port (73) in communication with the fluid inlet, and the piston defines a large pressure release chamber (71) in fluid communication with said fluid pressure port. The piston defines a small pressure release chamber (89) also in fluid communication with the fluid pressure port. A valve means (75,81) is operable, when fluid pressure in the large release chamber reaches a predetermined pressure, to communicate the large to a source of low pressure fluid.

8 Claims, 6 Drawing Sheets

ROTARY FLUID PRESSURE DEVICE AND IMPROVED BRAKE ASSEMBLY FOR USE THEREWITH

BACKGROUND OF THE DISCLOSURE

The present invention relates to brake assemblies, and more particularly, to brake assemblies of the type intended for use with fluid pressure actuated devices such as hydrostatic motors. Although the present invention is not necessarily limited to being used with a fluid pressure actuated motor, the invention does rely, in part, on the presence of pressurized fluid for its operation, and therefore, the invention will be described in connection with a hydrostatic motor.

Although the present invention may be included advantageously with many different types of fluid pressure actuated devices, it is especially adapted for use with a low-speed, high-torque ("LSHT") gerotor motor, and will be described in connection therewith. As is well known to those skilled in the art, brake assemblies have become an important feature of many LSHT gerotor motors, especially when such motors are utilized for vehicle propel applications. Many vehicles propelled by hydrostatic drive circuits, which include LSHT gerotor motors, are operated on hilly terrain and on work sites involving grades, such that some sort of motor braking capability is extremely desirable, if not essential, for the safe operation of the vehicle.

In many vehicle applications for LSHT gerotor motors, the motor can have a device referred to as either a parking brake or a parking lock, the term "lock" being preferred in some instances, because it is intended that the device be engaged only after the vehicle is stopped. In other words, such parking "lock" devices are not intended to be dynamic brakes, which would be engaged while the vehicle is still moving, to bring the vehicle to a stop. However, the term "brake" has also been used, and will generally be used hereinafter to mean and include both brakes and locks. The term "brake" is somewhat preferred, to refer to a device which can be applied gradually, and to distinguish from a device which would operate only fully engaged or fully disengaged.

Examples of LSHT gerotor motors incorporating brake arrangements are illustrated and described in U.S. Pat. Nos. 6,062,835; 6,132,194; and 6,321,882, all of which are assigned to the assignee of the present invention and incorporated herein by reference. The brake arrangements in the above-incorporated patents are all of the "spring-applied, pressure-released" type in which a spring biases the brake arrangement into its "engaged" condition, braking the motor output. Although the present invention is not strictly limited to use with a brake arrangement of the spring-applied, pressure-released type, such is the most common arrangement, and the invention will be illustrated and described in connection therewith.

In order to move the brake arrangement to its "disengaged" condition, permitting normal output shaft rotation, fluid pressure must be applied to a piston seated against the biasing spring, the fluid pressure biasing the piston to overcome the force of the biasing spring, moving the piston and spring to a retracted position. As is now well known to those skilled in the art, it is preferable to make the release piston area as large as possible, thereby reducing the required release pressure. However, as the release piston is made larger, the entire brake assembly becomes larger, more complicated and more expensive.

Many gerotor motors are utilized in "closed loop" hydrostatic systems in which there is some sort of charge pump providing a pilot pressure which may serve as the release pressure for the brake arrangement. However, many other LSHT gerotor motors are, instead, utilized in "open loop" hydrostatic systems in which there is no charge pump or other source of such a pilot pressure. For motors which are to be utilized in open loop systems, it is desirable to be able to utilize system pressure (i.e., the high pressure being communicated from the pump to the work circuit) as the release pressure for the brake assembly. However, in such an arrangement, the portion of system pressure required to move the release piston to its disengaged position represents a "loss" of pressure available to be converted into motor output torque. Therefore, it is desirable to have as large a piston as possible, and as low a release pressure as possible.

Unfortunately, if the release piston is made relatively large, in order to be able to disengage the brake at a very low release pressure, there is a serious potential problem when system pressure increases to 3000 psi or 4000 psi or perhaps even more. Full, relatively high system pressure acting on a large brake release piston area would result in many thousands of pounds of axial separating force within the brake assembly housing, far beyond what the brake assembly housing would be able to withstand, in the absence of extreme and very expensive measures to strengthen the brake assembly housing, and related components.

One known solution is to place a pressure reducing or relieving valve between the source of system pressure and the release chamber of the brake assembly, to make sure that the pressure in the release chamber would never exceed some predetermined, maximum pressure. However, such a pressure reducing or relieving valve would add substantially to the overall cost and complexity of the motor and brake assembly and of its plumbing installation.

BRIEF SUMMARY OF THE INVENTION

Accordingly, it is an object of the present invention to provide an improved brake assembly of the type which may be utilized with a fluid pressure operated device, in which the release piston may be operated by system pressure, but which overcomes the above-described problems.

It is a more specific object of the present invention to provide such an improved brake assembly, including a relatively large release piston, in which the brake assembly limits the release pressure applied to the piston, as system pressure increases above a predetermined level.

The above and other objects of the invention are accomplished by the provision of a rotary fluid pressure device of the type including a housing defining a fluid inlet and a fluid outlet. A rotary fluid displacement mechanism includes an output member having either orbital or rotational movement. The device includes an output shaft extending axially relative to the output member and is operable to transmit the movement of the output member. The housing defines a generally cylindrical brake chamber, and a piston member disposed in the brake chamber. The piston member is moveable between a first, retracted position under the influence of fluid pressure in the brake chamber, and a second engaged position under the influence of a biasing spring disposed in engagement with a rearward side of the piston member. Braking means is operably associated with the piston member and either the output member or the output shaft, such that movement of the piston member to the second, engaged position results in braking of the output shaft.

The improved rotary fluid pressure device is characterized by the housing defining a fluid pressure port in fluid communication with the fluid inlet. The piston member defines a first, large pressure chamber in fluid communication with the fluid pressure port. The piston member defines a second, small pressure chamber in fluid communication with the fluid pressure port. A valve means is operable, when the fluid pressure in the first, large pressure chamber reaches a predetermined pressure, to communicate the first, large pressure chamber to a source of low pressure fluid.

DETAILED DESCRIPTION OF THE PREFERRED EMBODIMENT

Figure 1:
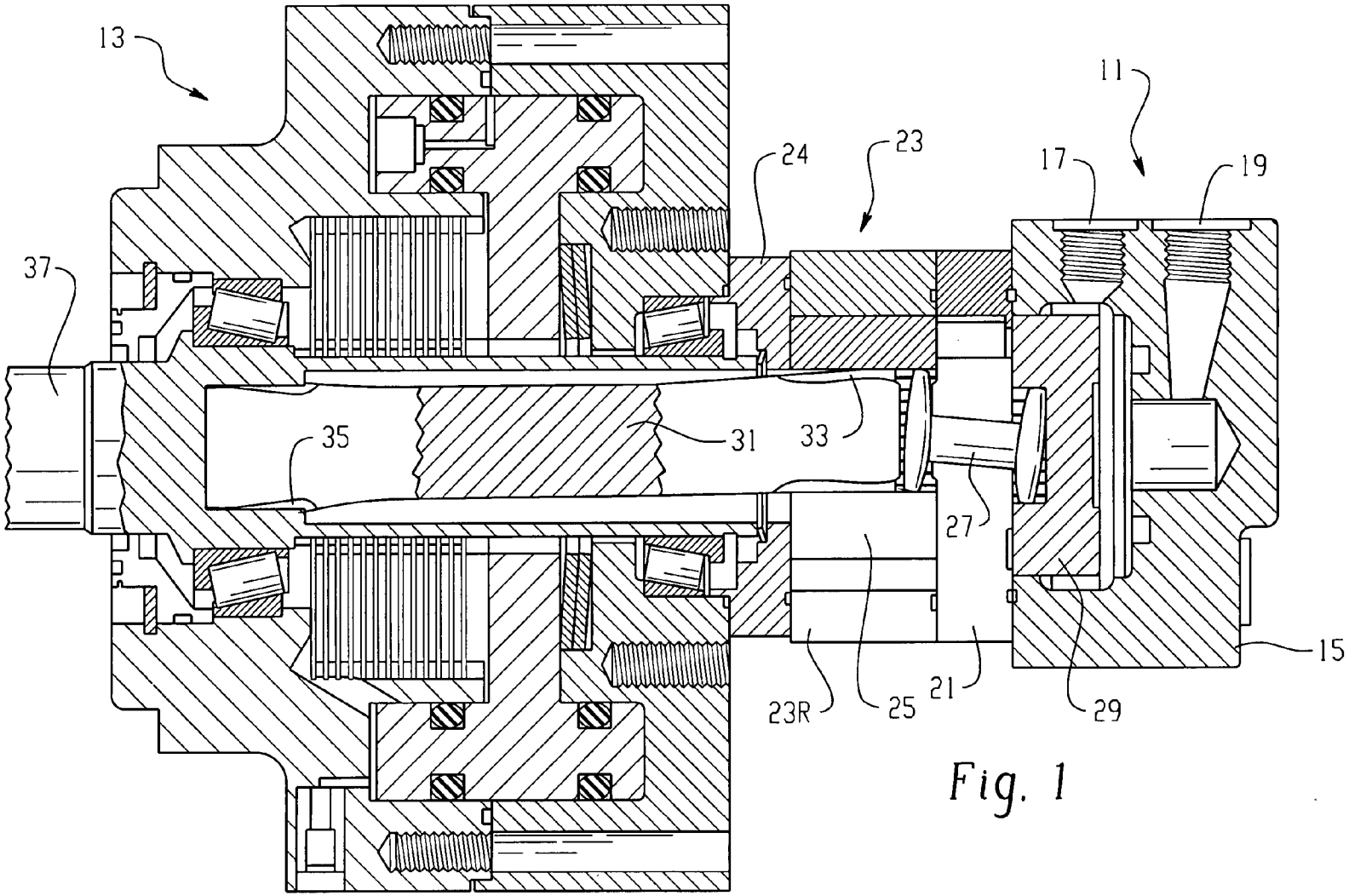
FIG. 1 is an axial cross section of a gerotor motor including a brake assembly made in accordance with the teachings of the present invention.

Referring now to the drawings, which are not intended to limit the invention, FIG. 1 illustrates a low-speed, high-torque ("LSHT") gerotor motor of the type with which the brake assembly of the present invention may be utilized advantageously. However, as mentioned previously, the invention is not limited to only gerotor motors, or to only LSHT motors, nor is the invention even limited to use only with motors. FIG. 1 illustrates a gerotor motor of the general type illustrated and described in U.S. Pat. No. 4,762,479, assigned to the assignee of the present invention and incorporated herein by reference.

The entire motor as shown in FIG. 1 comprises a motor portion, generally designated 11, and a brake portion or brake assembly, generally designated 13. The motor portion 11 comprises an end cap 15 defining a fluid inlet port 17 and a fluid outlet port 19. Disposed adjacent the end cap 15 is a port plate 21, and adjacent thereto (moving "forwardly", or to the left in FIG. 1) is a fluid displacement mechanism which, in the subject embodiment, comprises a gerotor gear set generally designated 23. Finally, disposed adjacent the gerotor gear set 23, and immediately adjacent the brake assembly 13, is a wear plate 24.

As is well known in the art, the gerotor gear set 23 includes an outer, internally-toothed ring member 23R, and disposed therein, an externally-toothed star member 25, which undergoes orbital and rotational movement in response to pressurized fluid being communicated from the inlet port 17 to the expanding volume chambers. The rotational movement of the star member 25 is transmitted by means of a valve drive shaft 27 to a rotatable disk valve member 29. As is also well known to those skilled in the art, the function of the rotatable disk valve member 29 is to control the communication of pressurized fluid from the inlet port 17 to the gerotor gear set, and to control the communication of low pressure, exhaust fluid from the gerotor gear set 23 to the outlet port 19.

Figure 2:
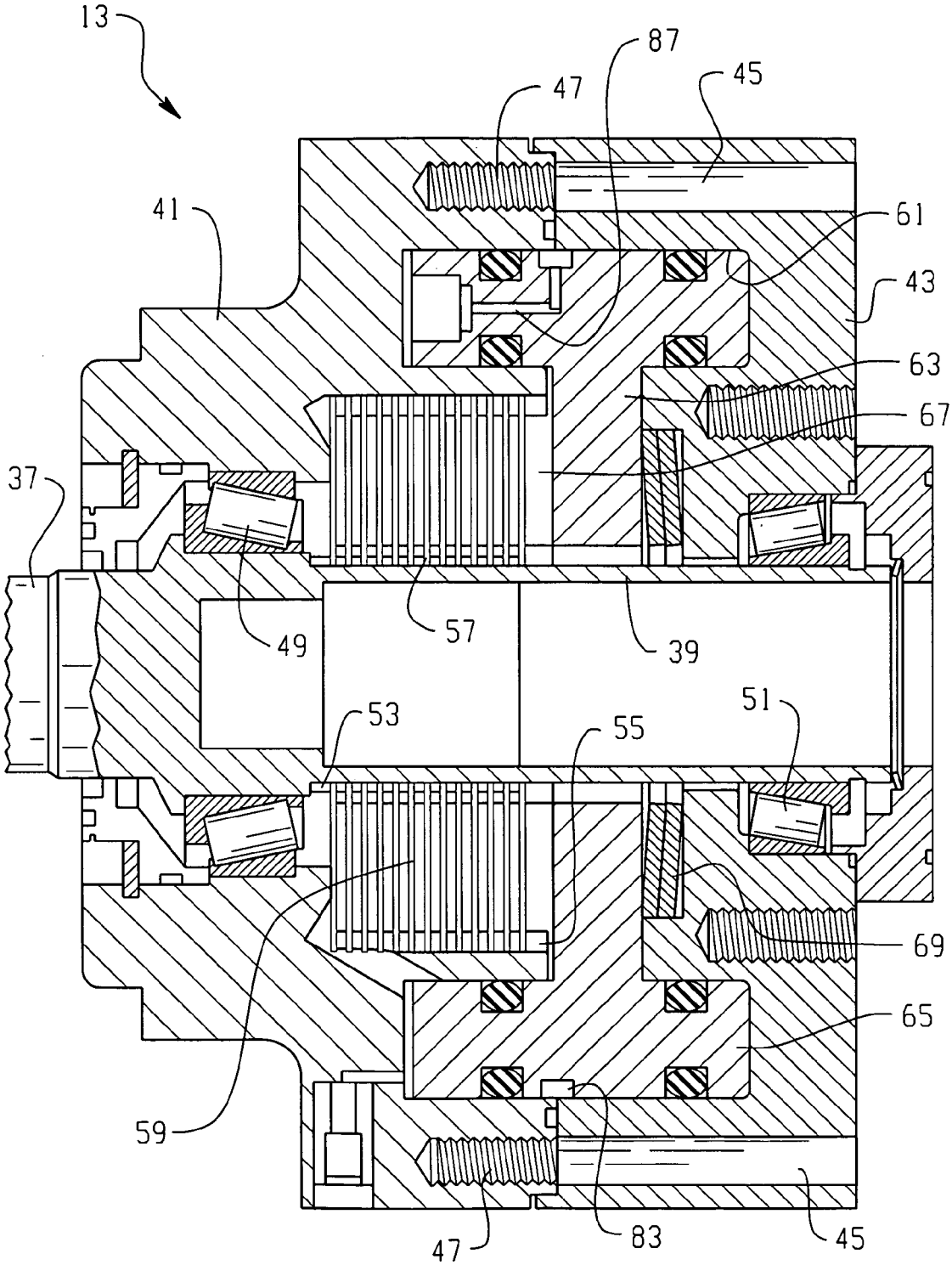
FIG. 2 is an enlarged, axial cross section of the brake assembly shown in FIG. 1, but with several parts omitted for ease of illustration.

Also in splined engagement with the star member 25 is a main drive shaft 31 (also referred to as a "dogbone" shaft) having a rearward set of crowned splines 33 in splined engagement with internal splines in the star member 25, and a forward set of crowned splines 35 in splined engagement with internal splines in an output shaft 37 (shown only fragmentarily in FIGS. 1 and 2). Referring now primarily to FIG. 2, it may be seen that the output shaft 37 includes a long, hollow, cylindrical portion 39, and in FIG. 2 it may be seen that the main drive shaft 31 is omitted for ease of illustration.

The brake portion 13 comprises a forward brake housing 41 and a rearward brake housing 43, which would typically be bolted together in tight sealing engagement by a plurality of bolts (omitted from FIG. 2), and by means of a plurality of bolt holes 45 and internally threaded portions 47.

Referring still to FIG. 2, the output shaft 37 is rotatably supported relative to the forward brake housing 41, by means of a bearing set 49 and similarly, the hollow cylindrical portion 39 is rotatably supported, relative to the rearward brake housing 43, by a bearing set 51. The hollow cylindrical portion 39 defines a set of external splines 53, and disposed radially outward therefrom, the forward brake housing 41 defines a set of internal splines 55. Disposed between the two sets of splines 53 and 55 is a braking device, including a set of internally splined brake disks 57 (in splined engagement with the external splines 53), and a set of externally splined brake disks 59, in splined engagement with the internal splines 55.

The forward brake housing 41 and the rearward brake housing 43 cooperate to define a somewhat "T-shaped" (in half cross-section), generally cylindrical brake chamber 61, and disposed therein is a brake piston 63, with the reference numeral "63" being associated in FIG. 2 with a radially-extending portion of the overall brake piston. The brake piston 63 also includes a generally cylindrical, radially outer piston portion 65, which extends axially to fill most of the brake chamber 61.

Disposed forwardly of the radial portion 63 of the brake piston is an annular washer 67, by means of which the brake piston is able to exert an axial biasing force on the brake disks 57 and 59, biasing them toward an engaged position, operable to limit rotation of the output shaft 37 relative to the brake housing 41,43 or perhaps even prevent rotation of the output shaft 37 completely. Disposed in engagement with a rearward surface of the radial portion 63 of the brake piston is a set of Belleville washers 69, seated against an adjacent surface of the rearward brake housing 43, and operable to bias the brake piston 63 and the annular washer 67 toward the engaged position.

It will be understood by those skilled in the art that the particular configuration and arrangement of the various components of the brake portion 13 which have been described up to this point are not essential features of the invention, but for reasons discussed in the BACKGROUND OF THE DISCLOSURE, it is desirable for the brake piston, and specifically, the pressure release area thereof, to be relatively large, thus reducing the fluid pressure needed to overcome the biasing force exerted by the Belleville washers (springs) 69. Therefore, in the subject embodiment, and by way of example only, and as may best be seen in FIG. 3, a forward surface of the piston portion 65 cooperates with an adjacent surface of the brake chamber 61 to define a large, annular release chamber 71, the force of fluid pressure in the release chamber 71 tending to bias the brake piston 63 in a "rearward" direction (to the right in FIGS. 2 and 3), in opposition to the force of the Belleville springs 69, and also serving to unload any axial force tending to clamp the brake disks 57 and 59 together in frictional engagement.

Figure 3:
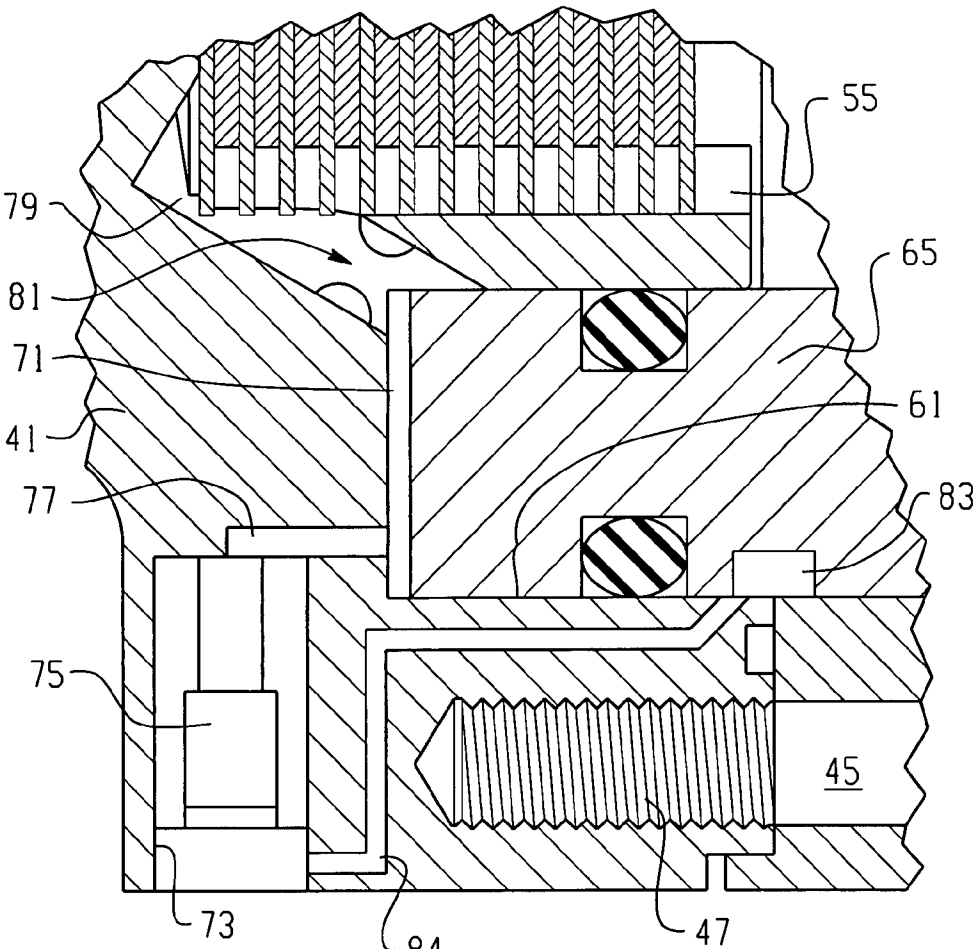
FIG. 3 is a further enlarged, fragmentary, axial cross section similar to FIG. 2, illustrating one aspect of the present invention.

Referring now primarily to FIG. 3, the forward brake housing 41 defines a fluid pressure port 73 which is preferably in fluid communication with the fluid inlet port 17 of the motor portion 11. The fluid communication from the inlet port 17 to the fluid pressure port 73 may be accomplished in any of a number of well known ways, utilizing appropriate hoses and fittings, or may be accomplished without external connection by means of various internal ports and passages. The particular arrangement for connecting the fluid inlet port 17 to the fluid pressure port 73 is believed to be within the ability of those skilled in the art, is not essential to the present invention, and will not be described further herein.

Disposed within the fluid pressure port 73 is a valve member, shown herein, somewhat schematically, as a valve spool 75, and as system pressure begins to build, pressure and flow are communicated past the valve spool 75 and by means of a passage 77 into the release chamber 71. Those skilled in the art will recognize that a certain, predetermined volume of fluid must enter the release chamber 71 in order to compress the Belleville spring 69 to the extent necessary to disengage the clutch pack. The valve spool 75 will be described in greater detail subsequently, as the operation is described in some detail.

As the system pressure continues to rise, the fluid pressure in the release chamber 71 will bias the brake piston 63 to the right in FIGS. 1 through 3, to its disengaged position. As may best be seen in FIG. 2, the portions of the forward and rearward brake housings 41 and 43, immediately radially inward of the piston portion 65 are spaced close enough to the radial portion 63 of the brake piston that there is relatively little axial movement of the brake piston, although the axial movement which is permitted is, and must be, sufficient to provide the entire, desired range of brake conditions, from fully disengaged to fully engaged.

As the system pressure continues to rise, the pressure will eventually reach a predetermined maximum system pressure which is selected or determined such that the total area of the release chamber 71, multiplied by the predetermined maximum pressure, is equal to or less than a maximum desired axial separating force permitted to act on the forward and rearward brake housings 41 and 43. See the line marked "Predetermined Maximum Force" in the graph of FIG. 7.

Referring still primarily to FIG. 3, but in conjunction with FIG. 2, there is an angled fluid passage 79 in fluid communication between the release chamber 71 and the "case drain" region of the brake portion 13, i.e., that portion in which the brake disks 57 and 59 are located. Disposed within the angled passage 79 is a fixed orifice 81, the function of which is to permit fluid communication from the release chamber 71 to the case drain region of the brake portion 13. Preferably, the fixed orifice 81 is sized, relative to the flow through the valve spool 75 and passage 77 such that, as the system pressure rises, the flow through the release chamber 71 to case drain will "saturate" the fixed orifice 81, and maintain in the release chamber 71 a pressure which is nearly as high as system pressure.

Figure 6:
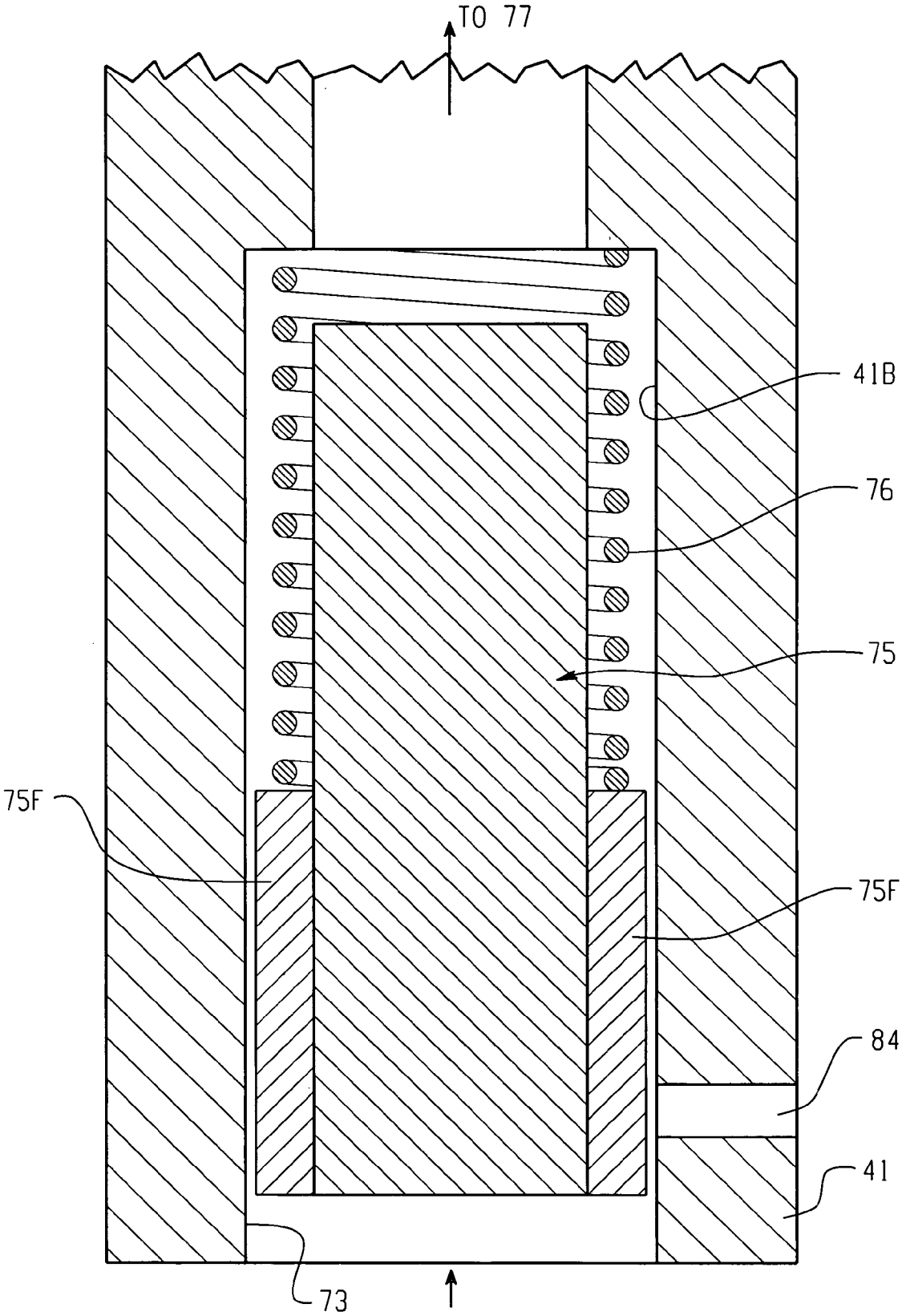
FIG. 6 is a greatly enlarged axial cross-section, similar to FIG. 3, showing in some detail an embodiment of the valve spool which comprises one aspect of the invention.

Referring now primarily to FIGS. 3 and 6, the valve spool 75 will be described in greater detail. The forward brake housing 41 defines a stepped bore 41B communicating between the fluid pressure port 73 and the fluid passage 77. The valve spool 75, which can have many different configurations, is shown herein as comprising a generally cylindrical portion (shown in cross-section), with a series of fluted portions 75F disposed toward the upstream end of the valve spool 75. The fluted portions 75F serve to center the valve spool 75 within the stepped bore 41B, while permitting fluid flow past the valve spool 75 to the fluid passage 77. The valve spool 75 is biased toward its "open" position, when the system pressure in the fluid pressure port 73 is relatively low, by means of a biasing spring 76. Those skilled in the art will understand that the valve spool is shown somewhat schematically herein, for ease of illustration. For example, a downstream end of the valve spool 75 may need to include structure to help center the spool within the bore 41B. Additionally, it would probably be preferred to provide the bore 41B and the valve spool 75 with more conventional "seat and poppet" structure.

As the system pressure initially builds from a substantially zero pressure, a system pressure will be reached sufficient to generate a force (see the graph marked "71" in FIG. 7) sufficient to overcome the biasing force of the Belleville washers 69 (see the line marked "69" in the graph of FIG. 7), and disengage the brake. In the subject embodiment, and by way of example only, when system pressure reaches about 200 psi. (13.6 bar), that pressure acting on the area of the release chamber 71 (see FIG. 5) will be sufficient to overcome the biasing force of the Belleville washers (springs) 69 and move the brake piston 63 from its engaged position, braking the output shaft 37, to its disengaged position, permitting rotation of the output shaft 37. Thus, it is preferred that the pressure at which the brake piston 63 is disengaged is substantially less than the predetermined, maximum pressure, and in the subject embodiment, it is less than a third.

As the system pressure continues to build, the valve spool 75 is gradually moved from the position shown in FIG. 6, in opposition to the force of the biasing spring 76, toward a closed position, in which the valve spool 75 blocks flow from the fluid pressure port 73 to the fluid passage 77. At about the point at which the system pressure reaches the predetermined, maximum pressure described previously, the valve spool 75 reaches a fully closed position, totally blocking communication of system pressure through the fluid passage 77 and into the release chamber 71. When that condition occurs, the fluid pressure in the release chamber 71 is quickly relieved to case drain, through the fixed orifice 81, until the pressure in the release chamber is substantially equal to reservoir pressure, or may be considered to be substantially "zero" for purposes of this explanation. See the downward, vertical force line in the graph of FIG. 7.

Figure 4:
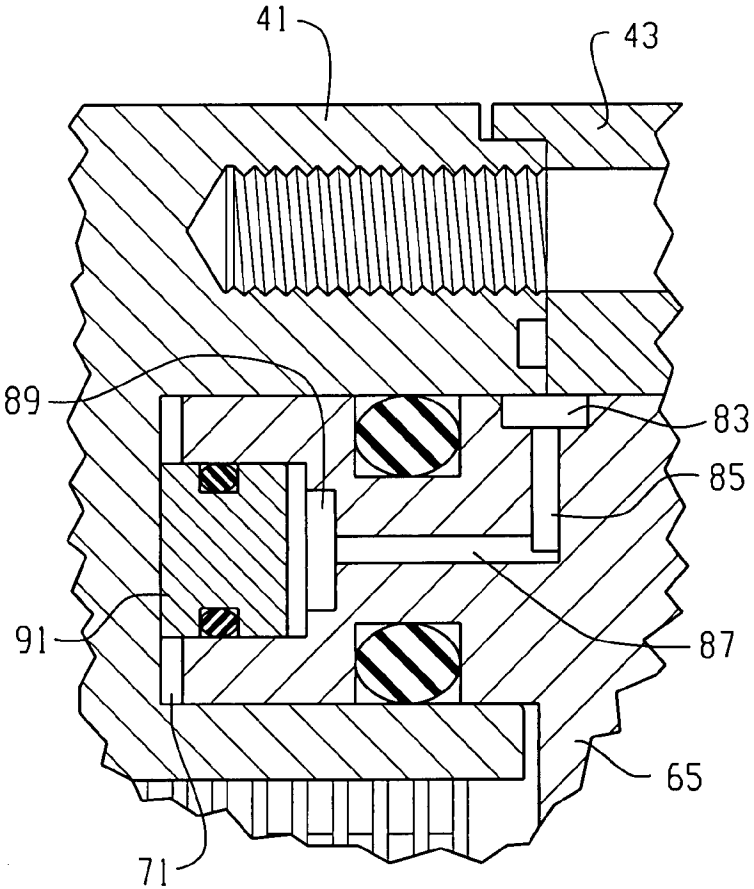
FIG. 4 is also a further enlarged, fragmentary, axial cross section of another portion of FIG. 2, on approximately the same scale as FIG. 2.

Referring now primarily to FIGS. 3 and 4, as the system pressure continues to increase, above the predetermined, maximum pressure described above, the pressure in the release chamber 71 remains substantially zero, because of the operation of the fixed orifice 81. The fluid pressure (system pressure) in the fluid pressure port 73 is communicated to an annular groove 83 formed about the outer periphery of the piston portion 65 of the brake piston 63, by means of a fluid passage 84. From the annular groove 83, pressure is communicated to a radial passage 85 defined by the piston portion 65, the passage 85 communicating with an axial passage 87. Pressurized fluid in the axial passage 87 flows into a small release chamber 89, which, as may be seen from FIGS. 4 and 6, is generally cylindrical. Disposed within the chamber 89 is a small piston member 91, which is preferably provided with an appropriate seal arrangement, to seal the small release chamber 89 from the large, main release chamber 71.

Figure 5:
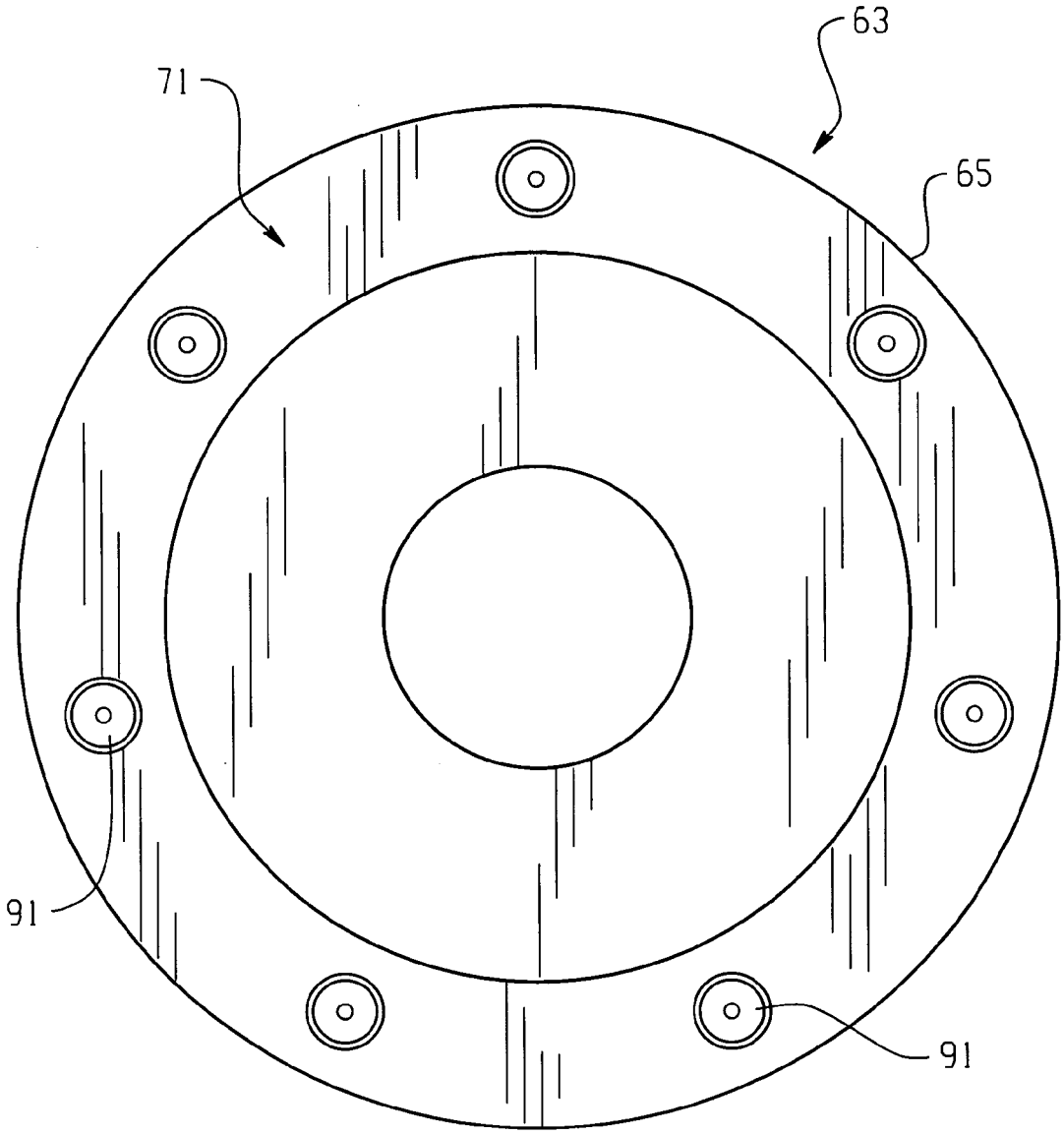
FIG. 5 is a front plan view of the release piston, illustrating one aspect of the invention.

As may best be seen in FIG. 5, there are, in the subject embodiment, but by way of example only, seven of the small release chambers 89 and small piston members 91. As a result, it will be understood that references hereinafter, and in the appended claims, to the "small pressure release chamber" will contemplate a "release chamber" which is actually the sum of the seven individual release chambers 89. In accordance with one aspect of the present invention, the total area of the release chamber 89 is substantially less than the area of the release chamber 71. In the subject embodiment, but by way of example only, the area of the release chamber 71 is about 14 times that of the release chamber 89. This relationship is significant for reasons to be described subsequently.

Figure 7:
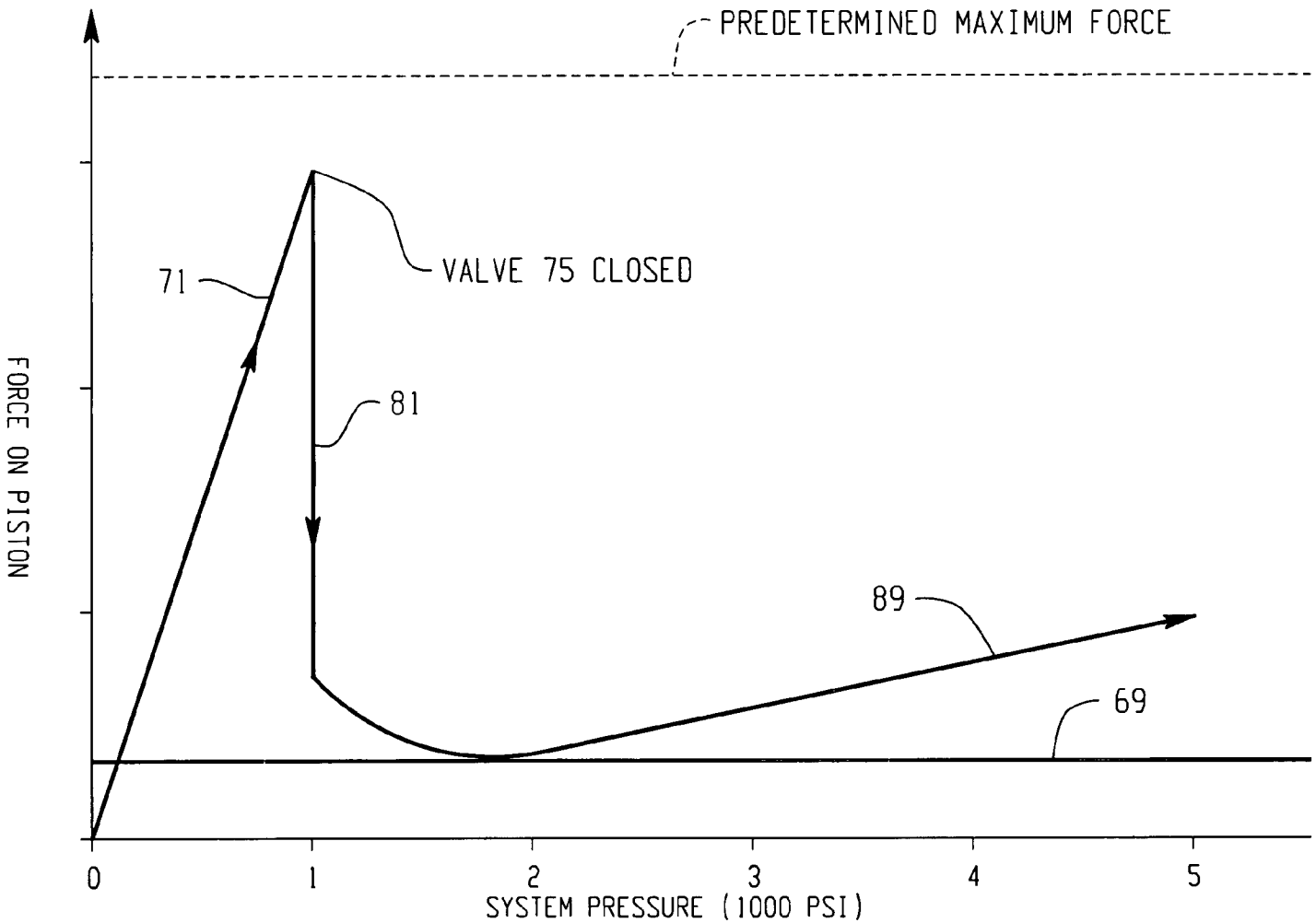
FIG. 7 is a graph of hydraulic force on the brake piston as a function of system pressure, illustrating several key aspects of the present invention.

As the system pressure increases to a pressure greater than the predetermined, maximum pressure (1000 psi. or 68 bar in the earlier example), and the pressure in the release chamber 71 drops to case drain pressure as described previously, the only pressure maintaining the brake piston 63 in its disengaged position is the pressure in the seven release chambers 89. However, because the total area of the release chamber 89 is substantially less than that of the release chamber 71, the predetermined, maximum pressure, and the area of the release chamber 89 must be selected such that the resulting force on the brake piston 63 is greater than the force of the Belleville springs 69. Thus, it may be seen in the graph of FIG. 7 that the force line, after dropping almost vertically (line marked "81" in FIG. 7) at about 1000 psi. (68 bar), slows its descent, then reaches a minimum at about 2000 psi. (136 bar), but always stays above the force (line "69") necessary to maintain the brake piston 63 in its disengaged condition. Those skilled in the art will understand that, because of the presence of the fixed orifice 81, the shape of the transition from the line "81" to the line "89" may not be exactly as shown in FIG. 7, but will vary as a function of a number of different variables.

Thereafter, as system pressure continues to increase, the force on the brake piston 63 gradually increases (the line marked "89" in FIG. 7), but at a much slower rate than the force on the brake piston increased while the system pressure went from 0 psi. to about 1000 psi. (68 bar). However, as may be seen in FIG. 7, the relatively small size of the release chamber 89 insures that, even as system pressure increases, the force on the brake piston 63 will not even approach the "Predetermined Maximum Force".

Thus, the present invention provides a brake assembly which can operate on system pressure to disengage the brake piston at a very low system pressure (using a "large" release chamber), but which then has the large release chamber drained, and thereafter, with increasing system pressure, uses only a relatively "small" release chamber to maintain the brake piston disengaged. With the brake assembly of the present invention, the force on the brake piston never exceeds a Predetermined Maximum Force, but, after initially disengaging the piston, and as the system pressure increases, the force on the piston never drops below that necessary to maintain the piston in its disengaged condition.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type including a housing defining a fluid inlet and a fluid outlet; a rotary fluid displacement mechanism including an output member having one of orbital and rotational movement; said device including an output shaft extending axially relative to said output member and operable to transmit said movement of said output member; said housing defining a generally cylindrical brake chamber, and a piston member disposed in said brake chamber, said piston member being moveable between a first, retracted position under the influence of fluid pressure in said brake chamber, and a second engaged position under the influence of a biasing spring disposed in engagement with a rearward side of said piston member; and braking means operably associated with said piston member and one of said output member and said output shaft, such that movement of said piston member to said second, engaged position results in braking of said output shaft; characterized by:

(a) said housing defining a fluid pressure port in fluid communication with said fluid inlet;

(b) a first area of said piston member defining at least a portion of a first pressure release chamber that is in fluid communication with said fluid pressure port;

(c) a second area of said piston member defining at least a portion of a second pressure release chamber that is in fluid communication with said fluid pressure port, wherein said second area is less than said first area;

(d) valve means operable, wherein fluid pressure in said first pressure release chamber reaches a predetermined pressure, to communicate said first pressure chamber to a source of low pressure fluid.

2. A rotary fluid pressure device as claimed in claim 1, characterized by said rotary fluid displacement mechanism comprises a gerotor gear set, including an internally-toothed ring member and an externally-toothed star member having said orbital and rotational movement relative to said ring member, said star member comprises said output member.

3. A rotary fluid pressure device as claimed in claim 1, characterized by said output shaft extending axially through said brake chamber and being surrounded by said piston member, said braking means comprising a first friction member fixed to rotate with said output shaft and a second friction member fixed to rotate with said housing.

4. A rotary fluid pressure device as claimed in claim 1, characterized by said first area of said piston member defining an annular surface on a forward side thereof said annular surface cooperating with a piston chamber defined by said housing to define said first pressure release chamber.

5. A rotary fluid pressure device as claimed in claim 4, characterized by said piston member defining a plurality of recesses opening into said first pressure release chamber, a plug member disposed in each of said recesses, each of said plug members defining a forward surface and a rearward surface, said plurality of rearward surfaces cooperating with said piston member to define said second pressure release chamber, said housing and said piston member cooperating to provide fluid passage means communicating fluid pressure from said fluid pressure port to said second pressure release chamber.

6. A rotary fluid pressure device as claimed in claim 1, characterized by said valve means comprises an orifice disposed between said first pressure release chamber and a source of low pressure fluid.

7. A rotary fluid pressure device as claimed in claim 6, characterized by said valve means further comprises a moveable valve member disposed between said fluid pressure port and said first pressure release chamber, said valve member being biased by a biasing spring toward an open position, permitting flow from said fluid pressure port into said first pressure release chamber, and being biased by increasing pressure in said fluid pressure port toward a closed position, blocking flow from said fluid pressure port into said first pressure release chamber.

8. A method of releasing a brake for a rotary fluid pressure device comprising the steps of:

supplying pressurized fluid to a rotary fluid pressure device, wherein said rotary fluid pressure device includes a brake assembly having a brake chamber and a piston member disposed in said brake chamber with said piston member having a first area defining at least a portion of a first pressure release chamber and a second area defining at least a portion of a second pressure release chamber, with said first area being larger than said second area;

communicating said pressurized fluid to at least said first pressure release chamber through a valve;

relieving said pressurized fluid in said first pressure release chamber when said pressurized fluid reaches a predetermined pressure; and communicating said pressurized fluid only to said second pressure release chamber while said first pressure release chamber is relieved.

* * * * *